US007243872B2

(12) United States Patent
Peeters et al.

(10) Patent No.: US 7,243,872 B2
(45) Date of Patent: Jul. 17, 2007

(54) DEVICE FOR DETECTING AND/OR ADJUSTING A TENSILE FORCE IN A YARN

(75) Inventors: Jozef Peeters, Ieper (BE); Peter Deruytter, Ieper (BE)

(73) Assignee: Picanol N.V., Ieper (BE)

( * ) Notice: Subject to any disclaimer, the term of this patent is extended or adjusted under 35 U.S.C. 154(b) by 35 days.

(21) Appl. No.: 10/504,853

(22) PCT Filed: Feb. 21, 2003

(86) PCT No.: PCT/EP03/01782

§ 371 (c)(1),
(2), (4) Date: Mar. 23, 2005

(87) PCT Pub. No.: WO03/074404

PCT Pub. Date: Sep. 12, 2003

(65) Prior Publication Data

US 2005/0150564 A1 Jul. 14, 2005

(30) Foreign Application Priority Data

Mar. 4, 2002 (DE) ..... 102 10 911

(51) Int. Cl.
*B65H 59/14* (2006.01)
*D03D 47/34* (2006.01)

(52) U.S. Cl. ..... 242/419.7; 242/154; 226/44; 139/201

(58) Field of Classification Search ..... 226/44, 226/45, 97.4; 242/419.7, 154; 139/194, 139/200, 201
See application file for complete search history.

(56) References Cited

U.S. PATENT DOCUMENTS

| | | | | |
|---|---|---|---|---|
| 3,834,635 | A * | 9/1974 | Pfarrwaller | 242/365.4 |
| 4,010,915 | A | 3/1977 | Strutz et al. | |
| 4,854,513 | A * | 8/1989 | Boller et al. | 242/476.7 |
| 5,462,094 | A | 10/1995 | Josefsson et al. | |
| 5,520,351 | A * | 5/1996 | Prospero et al. | 242/419.7 |
| 5,660,213 | A * | 8/1997 | Tholander et al. | 139/452 |

FOREIGN PATENT DOCUMENTS

| | | |
|---|---|---|
| DE | 2553859 | 11/1976 |
| DE | 2535209 | 6/1977 |
| DE | 19858682 | 6/2000 |
| FR | 915401 | 11/1946 |
| FR | 915401 A * | 11/1946 |
| GB | 730035 | 5/1955 |
| GB | 2125072 | 2/1984 |
| JP | 53-126470 | 11/1978 |
| JP | 2-193871 | 7/1990 |
| WO | 00/44970 | 4/2003 |

* cited by examiner

*Primary Examiner*—Patrick Mackey
*Assistant Examiner*—William E. Dondero
(74) *Attorney, Agent, or Firm*—Bacon & Thomas, PLLC

(57) ABSTRACT

Apparatus monitoring and/or adjusting tensile force in a yarn (10) including at least three consecutive yarn deflecting elements (11, 12, 13) of which the central deflecting element (12) is displaceably held by a retention device (14) that is supported in such a way that the motion and/or position of the deflecting element (12) is substantially a function only of the tensile force F1 in one yarn segment, such segment being situated between the displaceable deflecting element (12) and only one of the two neighboring deflecting elements (11 or 13).

10 Claims, 2 Drawing Sheets

DEVICE FOR DETECTING AND/OR ADJUSTING A TENSILE FORCE IN A YARN

BACKGROUND OF THE INVENTION

A. Field of the Invention

The present invention relates to an apparatus for monitoring and/or adjusting a tensile force in a yarn, said apparatus comprising yarn deflecting-elements one of which is displaceably held by a retention means that is fitted with a device for monitoring and/or adjusting its motion and/or its position and/or the torque it applies and/or the retention force it exerts.

B. Related Art

It is known from the German patent document 2,535,209 A1 to displaceably hold a central deflecting element by a swivel arm supported in a plane connecting two further deflecting elements. The swivel arm is held by an electric motor drive in a preselected deflecting position. The required current magnitude is a signal representing yarn tension or yarn tensile force.

It is further known from the German patent document 2,553,859 A1 to mount two mutually oppositely displaceable deflecting elements between two stationary deflecting elements on a common, two-arm swivel lever which is supported in a plane linking the two stationary deflecting elements. An electric motor drive is associated with the two-arm lever. The required pivot force is determined by measuring the electric power and is representative of yarn tension or yarn tensile force.

It is further known from the British patent 2,125,072 A to load an electromagnetic drive holding a central deflecting element with a constant drive force. Arm excursion is detected by an optical device to provide a measure of yarn tensile force or yarn tension.

Also, U.S. Pat. No. 4,010,915 discloses a yarn brake having two stationary deflecting elements and two oppositely displaceable deflecting elements between them. This yarn brake is regulated in a way such that the yarn tension remains substantially constant in front of the yarn brake. A tension sensor precedes the yarn brake for that purpose.

U.S. Pat. No. 5,462,094 also discloses a yarn brake consisting of two stationary deflecting elements and one displaceable deflecting element configured between them in a weaving machine filling insertion system. The yarn brake is mounted between a prewinder and a device inserting the fillings into a shed. The central deflecting element is displaceable transversely relative to the direction of yarn motion. The braking magnitude depends on the excursion implemented by the central deflecting element and is measured and regulated by a tension sensor.

Moreover a yarn brake for a weaving machine insertion system is known from WO 00/44970, said brake being mounted between a prewinder and a main blow nozzle of an airjet weaving machine. The yarn brake is composed of two stationary deflecting elements and a central displaceably held deflecting element. The position of the displaceable deflecting element is program-controlled. For that purpose the position of the central deflecting element is detected and then compared with a program-selected nominal position. In the event of discrepancies between the instantaneous position and the desired nominal position, the power applied to an electric drive motor adjusting the central element is changed in such manner that any discrepancy between the actual value and the nominal one shall be substantially eliminated.

In all the above apparatus, the yarn tensile force in the yarn segment beyond the central deflecting element is larger by the amount of friction between the yarn and the deflecting element than the yarn tensile force in the segment preceding the central deflecting element. Accordingly the force with which the retention means holds or supports the central deflecting element depends on the coefficient of friction between the particular yarn material and the deflecting element. In most cases however this coefficient of friction will not be known, and therefore the above designs do not enable accurately determining the yarn tension or yarn tensile force. This applies in particular to high yarn speeds on the plausible assumption that the coefficient of friction between the thread and the deflecting element varies with yarn speed.

SUMMARY OF THE INVENTION

An object of the present invention is to create apparatus of the above kind which enables monitoring the yarn tensile force or yarn tension force in the absence of knowledge of the coefficient of friction between the particular yarn and the displaceable deflecting element.

This problem is solved in that the retention means is structured and/or supported in such manner that the motion and/or position and/or the applied torque and/or the exerted retention force of the displaceably held deflecting element substantially depends on the tensile force in only one yarn segment that is situated upstream or downstream from the displaceable deflecting element.

Because, according to the invention, the motion and the position of the deflecting element and of the associated retention means depends on the tensile force only in one yarn segment, the signal derived from the motion and/or the position and/or the torque and/or the retention force of the holding means shall be directly proportional to the actual yarn tensile force, without entailing a calculation including the coefficient of friction.

In one advantageous embodiment of the present invention, the retention means of the displaceable deflecting element is a swivel arm the pivot shaft of which coincides at least approximately with the deflection site of a neighboring deflecting element. The yarn tensile force between the displaceable deflecting element and the deflecting element coinciding with the pivot shaft essentially runs in the longitudinal direction of the lever arm, as a result of which this yarn tensile force does not exert a torque on the swivel arm. The torque applied on the swivel arm therefore depends on the yarn tensile force in the other yarn segment. Hence the signal so attained directly represents a yarn tensile force which does not require further calculation involving a coefficient of friction. Under practical conditions, the pivot shaft and the deflection site of the previous or subsequent deflecting element will rarely coincide precisely. However modest deviations are substantially insignificant because of the absence of enough leverage, as a result of which a torque arising thereby shall be negligibly small.

In a further embodiment of the present invention, the swivel arm's pivot shaft coincides at least approximately with the deflection site of the deflecting element because being situated in front of the displaceably held deflecting element as seen in the yarn's direction of motion. In a preferred embodiment, and as seen in the direction of yarn motion, the deflecting element following the displaceable deflecting element is arranged at a distance which is larger than the distance between this displaceable deflecting element and the deflecting element which precedes it. The larger the distance between the displaceable element and the subsequent element, the smaller the differential between the measured yarn tensile force and the yarn tensile force beyond the stationary, upstream deflecting element will be.

In a further embodiment of the present invention, the apparatus is mounted within a weaving machine's filling insertion-system. In an especially advantageous manner, this apparatus will be a yarn brake for a weaving machine's filling insertion-system.

However, such apparatus also may assume a further function in being designed as apparatus to retract the filling of an airjet weaving machine's blow nozzle. For that purpose the swivel arm may be moved by its electric drive motor into an appropriate position when the weaving process is interrupted.

DESCRIPTION OF THE DRAWINGS

Further features and advantages of the present invention are elucidated by the illustrative embodiments discussed below and shown in the appended drawings.

DETAILED DESCRIPTION OF PREFERRED EMBODIMENTS OF THE INVENTION

Figure 1:
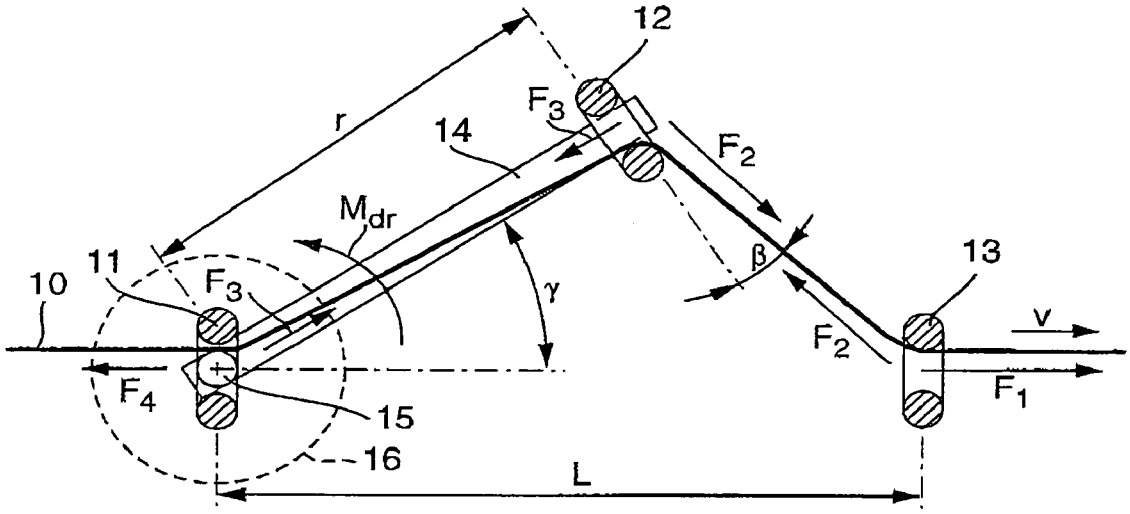
FIG. 1 is a functional diagram of an apparatus of the invention.

In the illustrative embodiment of FIG. 1, a yarn 10 runs through a first yarn deflecting element 11 in the form of a yarn eyelet, then through a second deflecting element 12 also in the form of a yarn eyelet and through a third deflecting element 13 again in the form of a yarn eyelet. The first deflecting element 11 and the third deflecting element 13 are fixed at a distance L apart. The intermediary deflecting element 12 is displaceably held by a swivel arm 14. The swivel arm 14 exhibits a length r and pivots about a pivot shaft 15 which coincides at least approximately with the deflection site constituted by the first deflecting element 11 for the yarn 10. The pivot shaft 15 is connected to an electric drive motor 16.

Yarn tensile force increases at each of the consecutive, irrotational deflecting elements. The yarn 10 at tensile force $F_4$ arrives at the first deflecting element where the tensile force increases to $F_3$. This yarn tensile force $F_3$ increases on account of friction against the deflecting element 12 to the tensile force $F_2$ which in turn increases at the deflecting element 13 to the yarn tensile force $F_2$, the latter being the tension at which the yarn 10 exits the apparatus. The yarn tensile force increases at each deflection site by the factor $e^{\mu\alpha}$.

In the above formula, e is the base of the natural logarithm, μ is coefficient of friction between the yarn and the deflecting element 11, 12, 13, and a is the looping angle subtended by the yarn on the deflecting element.

The yarn tensile force $F_3$ and $F_2$ act on the deflecting element 12. The swivel arm 14 holding the deflecting element 12 being supported in such a manner that its pivot shaft 15 coincides at least approximately with the deflection site of the deflecting element 11, the yarn tensile force $F_3$ substantially runs in the longitudinal direction of the swivel arm 14 and hence approximately perpendicularly to the pivot shaft 15. This yarn tensile force $F_3$ therefore does not apply a torque to the swivel arm 14, in other words no torque of practical consequence. The torque acting on the swivel arm 14 therefore is determined solely by the yarn tensile force $F_2$.

The torque $M_{dr}$ caused by the yarn tensile force $F_2$ is generated by that component of the yarn tensile force $F_2$ which runs perpendicularly to the swivel arm 14 through the deflecting element 12. Accordingly this torque ($M_{dr}$) is given by the formula $$M_{dr}=r\cdot F_2\cdot\cos\beta,$$

where r is the length of the swivel arm 3 and β is the angle subtended by the direction of the yarn tensile force $F_2$ and a direction extending perpendicularly to the swivel arm 14.

The angle β also may be stated in terms of an angle γ, that is, by the angle γ between the swivel arm 14 and the plane connecting the two deflecting elements 11 and 13. This angle y is detected by an angle pickup integrated into the electric drive motor 16, for instance by an encoder disk integrated in said drive 16. As a result the value cos β may be calculated as follows:

$$\cos\beta=\frac{\sin\gamma}{\sqrt{[1-2(r/L)\cos\gamma+(r/L)^2]}}$$

where L is the distance between the two deflecting elements 11 and 13.

This expression leads to the formula for the yarn tensile force $F_2$:

$$F_2=\left(\frac{M_{dr}}{r}\right)\left(\frac{\sqrt{[1-2(r/L)\cos\gamma+(r/L)^2}}{\sin\gamma}\right).$$

When the spacing L is a multiple of the length r of the swivel arm 14, the above formula simplifies to $$F_2=M_{dr}/(r\sin\gamma).$$

It is essential that the yarn tensile force $F_2$ thusly derived shall depend only on geometric magnitudes but not on the coefficient of friction between the yarn 10 and the deflecting element 12. The yarn tensile force can be determined from the motor's torque which can be measured or monitored at the electric motor drive 16.

When measuring the yarn tensile force $F_2$ using the apparatus of the invention, the central deflecting element 12 may be moved by the electric drive motor 16 into a predetermined site of excursion. The power input into the electric motor drive 16 required to keep the deflecting element 12 in said position is representative of the torque $M_{dr}$ and hence also of the yarn tensile force $F_2$.

Illustratively, when the apparatus of the invention is used as a yarn brake to be applied at a given time, its braking being monitored by means of the yarn tensile force $F_2$, then this step also may be implemented by means of the power input at the electric motor drive 16. In such a case tests are run to determine what current/power must be applied to the electric motor drive to move the swivel arm 14 together with the deflecting element 12 and the motor rotor into a plurality of consecutive angular positions. These stored values then may be compared with the required input of current/power to attain the same angular positions at the same speed against the opposing yarn tensile force $F_2$. The time function of the yarn tensile force during braking may also be determined in this manner. Illustratively the electric motor drive may be a stepping motor. However proportional moving, rotary magnets exhibiting a simple, linear relationship between torque and current/power input independently of motor position also may be used. Drives of other designs also are applicable, provided that the applied torque can be detected or determined. The torque also may be measured for instance at the motor shaft using appropriate test equipment.

When the swivel arm 14 is being accelerated, the measured or determined torque $M_{dr}$ corresponds to the applied motor torque $M_{motor}$ less the moment of inertia of the swivel arm 14 and electric motor drive 16. The angular is inertia J may be determined beforehand and will then be known. The moment of inertia is the product of the angular inertia J and the acceleration "b". The acceleration can be determined using the function of motion of the electric drive motor 16. Because the torque $M_{dr}$ can be determined continuously by monitoring the motor torque $M_{motor}$ and the acceleration "b", the yarn tensile force also can be determined continuously.

$$M_{dr}=M_{motor}-Jb.$$

When the swivel arm 14 is at rest, the torque $M_{dr}$ equals the motor torque $M_{motor}$. When the apparatus is used for instance as a yarn brake on a weaving machine, then the swivel arm 14 may need to be at rest for a (short) time interval, for instance in its end position. The yarn tensile force may be easily determined in that position. As regards other positions that will be crossed by the swivel arm, it will be necessary to determine the magnitude of the acceleration "b".

The apparatus of the invention also allows carrying out operational checks, for instance absences of yarn may be ascertained. Excessive acceleration, or excessive elongation or absence of torque during excursion may indicate yarn ruptures.

Various procedures and test equipment may be used to determine the angular positions and accelerations of the electric motor drive 16 together with the swivel arm 14 and the deflecting element 12. Illustratively incremental angle pickups may be used. However an angular speed pickup also may be used. For instance the electric voltage induced by a moving magnetic field in a stationary coil might be used, being proportional to the speed of this magnetic field. Where a permanent magnet is connected to shaft of the electric motor drive 16, a voltage induced in a stationary coil may be monitored. In that case the said induced voltage need only be calibrated in relation to the rotational speed. Thereupon the angular position may be inferred by integrating the angular speed, for instance by numeric or digital signal processing. A stop might be used in this respect which illustratively is situated in the plane common to the stationary deflecting elements 11, 13 and which resets the detector to zero each time before a braking procedure takes place.

Furthermore different kinds of angular-speed pickups may be used. Again, angular-acceleration pickups also may be used, which already provide acceleration as the output signal. Also contact-free techniques may be used to control the motor, that is, a position sensor may be eliminated entirely. As soon as the motor begins rotating, an inverted voltage is induced in the stator coils. This induced inverted voltage is related to speed and can be measured. Once this position is known, the position can be computed and be used as a feedback signal for motor control.

Figure 2:
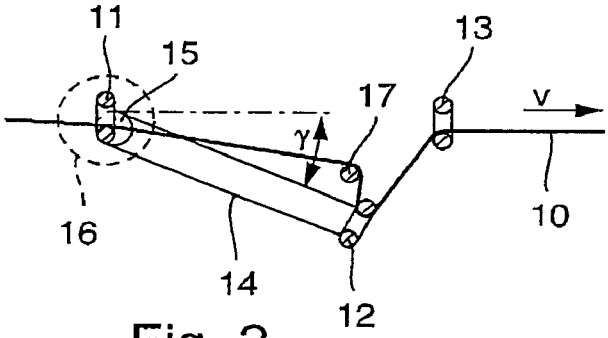
FIGS. 2, 3 are functional diagrams of apparatus of the invention that allows monitoring the yarn tensile force independently of the coefficient of friction, FIG. 4 schematically shows apparatus of the invention additionally functioning as a yarn clamp, FIG. 5 schematically shows a filling insertion system for airjet weaving machines fitted with apparatus according to the invention.
Figure 3:
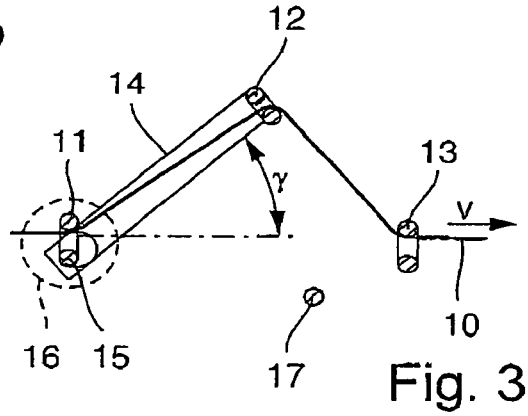

The embodiment of FIGS. 2 and 3 includes a further deflecting element 17 which may be used to decelerate the threads 10 when the braking arm 14 together with the deflecting element 12 is moved downward (as seen in the drawing) through the plane connecting the deflecting elements 11 and 13. At a given angle of swiveling, the yarn comes to rest against the deflecting element 17 and deceleration/braking is substantially enhanced as a result of the friction experienced at this deflecting element 17. The torque required to arrive at the position shown in FIG. 2 and to retain this position however now depends not only on geometric values as when the yarn loops around the deflecting element 17. Instead said torque now also depends on the coefficient of friction between the yarn and the deflection element 12.

It may be practically advantageous to limit the swivel arm excursion 14 in one or both directions by optionally displaceable stops.

Figure 4:
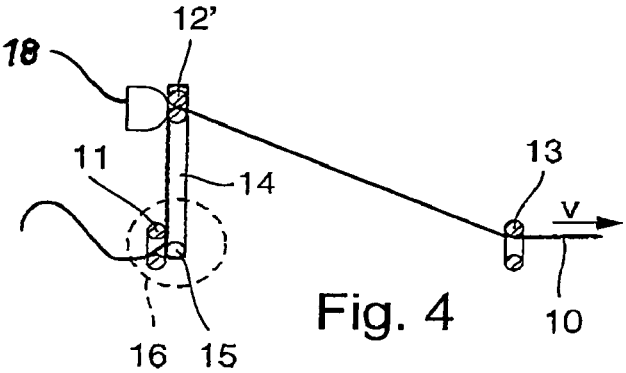

As shown in FIG. 4, the apparatus of the invention also may serve as a yarn clamp, for instance when the incoming yarn 10 is slackening. When the yarn incoming at the side of the deflecting element 11 becomes slack, the electric motor drive 16 will move the swivel arm 14 until its deflecting element 12' comes to rest against a stop 18 and in the process will clamp the yarn 10.

The apparatus of the invention is operative regardless of the direction of yarn advance. If illustratively the direction of advance of the yarn 10 in FIG. 1 were in the other direction (or if the pivot shaft 15 of the swivel arm would be configured in such manner in the region of the deflecting element 13 that it could coincide with its deflection site), then only the yarn tensile force in a yarn segment between the displaceably held deflecting element 12 and the stationary deflecting element 11 or 13 would generate a torque.

Figure 5:
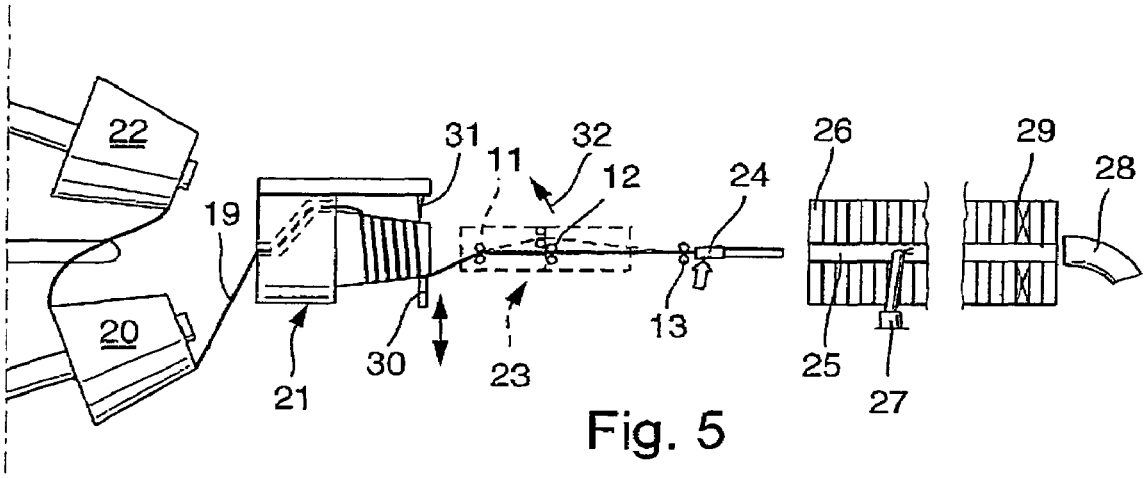

FIG. 5 schematically shows the integration of apparatus of the invention acting as a yarn brake into a filling insertion system of an airjet weaving machine. The filling to be inserted is drawn off a bobbin 20 and deposited in turns on a prewinder 21. In order to continuously weave once the bobbin 20 has been exhausted, the end of the filling of this bobbin 20 is connected to the beginning of a supply bobbin 22. After the bobbin 20 has been exhausted, filling insertion is continued from the bobbin 22 the yarn end of which in turn is connected to a further bobbin which shall be inserted. The filling 19 runs from the prewinder 21 through the apparatus 23 of the invention acting as yarn brake to a main blow jet 24 which is connected to a supply of compressed air as indicated by an arrow. Conventionally, two such main blowing nozzles 24 are mounted in cascade on the weaving machine's weft insertion side. During insertion, the filling 19 is guided in a reed's filling insertion channel 25. Moving the filling in the filling channel 25 of the reed is supported by several relay nozzles 27 which are located at equidistant spacings across the reed 26. The filling arriving at the end of the reed 26 opposite the main blow nozzle(s) 24 is trapped by a suction nozzle 28. The reed 26 also includes a filling stop-motion 29 monitoring the arrival of the filling 19.

The filling 19 is released at the prewinder 21 when a pin 30 is removed/loosened. The number of turns drawn off the drum of the prewinder 21 during insertion of one filling 19 are counted by a detector 31. A signal is emitted when the pre-selected number of turns has been drawn off and actuates the apparatus 23 acting as a yarn brake. At the beginning of filling insertion, the filling 19 is deflected neither by the apparatus 23 nor by a tension sensor. The electric drive motor 16 (FIG. 1) pivots the swivel arm 14 which is supported in the region of the deflection site of the deflecting element 11. As a result the filling will be deflected and decelerated. The braking effect can be adjusted by the apparatus of the invention and optionally it may also be regulated by it. As regards a simple problem solution, maximum braking is set or regulated or limited. For that purpose the maximum braking force is measured in the above described manner using the tensile force in the yarn segment which follows the displaceable deflecting element 13, and then it is compared to a predetermined nominal value. Braking may be adjusted in such a way that a predetermined yarn tensile force shall not be exceeded. If the yarn tensile force becomes excessive, braking will be reduced, that is, the deflection shall be made less, in order to avert yarn rupture. To change the yarn tensile force, for instance to reduce it, in addition to changing the deflection, or instead of it, another parameter may be changed, for instance the rate and/or the pressure of the compressed air blown out of the main blowing nozzle. The latter procedure may also be carried out manually, for instance when adjusting a machine, in particular an airjet weaving machine. As regards one embodiment variation, when a discrepancy is found between the measured braking force and the nominal value, the excursion of the swivel arm 14 together with the deflecting element 13 is changed in a way to result in correspondence between the measured yarn tensile force and the predetermined nominal yarn tensile force. The braking also may be adjusted over the course of time in corresponding manner. In this instance and in the above described manner, the time function of yarn tensile force in the yarn segment beyond the displaceable deflecting element 13 will be ascertained and compared with a predetermined yarn-tension time function. If there is discrepancy between the measured, actual value and the predetermined nominal value, the parameter of the swivel arm together with the deflecting element 13, in particular the path and/or the speed Is of the motion and/or the torque exerted by the electric motor drive 16, will be altered in such manner that the discrepancy between the actual, measured value and the nominal value shall be eliminated as much as possible. Also the rate or the pressure of the compressed air blown out of the main blow nozzle may be changed.

In the embodiment of FIG. 5, the intake to the main blow nozzle 24 acts as the third deflecting element 13 and consequently a very large spacing is subtended between the stationary deflecting element 11 of the apparatus 23 and the intake to the main blowing nozzle 24 acting as the deflecting element 13. This spacing/length is very large compared to the length of the swivel arm 14 and the yarn tensile force therefore is calculated using the above simplified formula. Moreover this yarn tensile force does not significantly differ from that present in the subsequent segment of the filling 19.

The apparatus of the invention shown in the embodiment blowing of FIG. 5 furthermore includes the function of retracting the filling from the blowing range of the main blow nozzle 24 in the event weaving is interrupted or during filling insertion by one or more main blowing nozzles or upon termination of filling insertion. For that purpose the deflecting element 12 of the apparatus 23 is pivoted by the swivel arm so far in the direction of the arrow 32 that the beginning of the filling 19 is retracted from the blowing range of the main blowing nozzle. Thereupon the filling remains tensioned by means of the suction from the main blow nozzle 24 without however exposure at its end to a strong flow of blowing air that might damage the filling 19.

Figure 6:
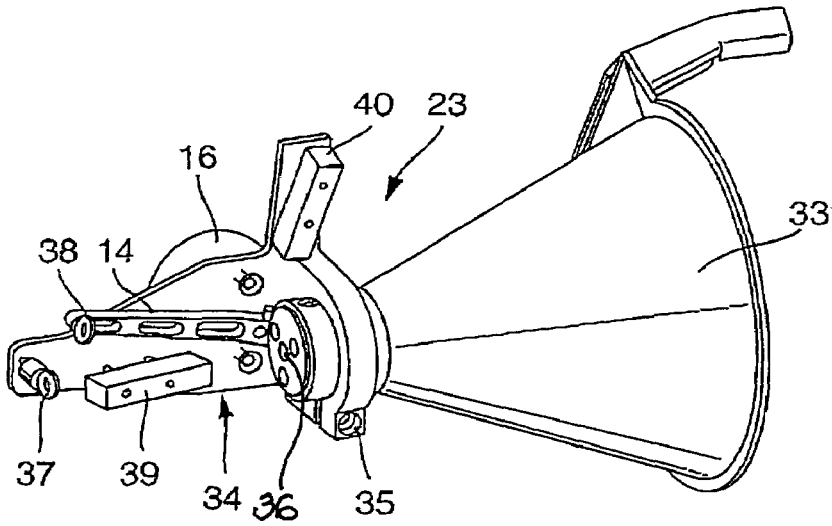
FIG. 6 is a view of a practical embodiment of an apparatus according to the invention.

FIG. 6 shows an embodiment of apparatus 23 which is combined with a balloon limiter 33 mounted to the prewinder 21. A retention device 34 is affixed by a clamp 35 to the end of the balloon limiter 33. The substantially angular retention device comprises an eyelet 36 acting as the first deflecting element 11. A second eyelet 37 is mounted at a relatively large distance from the eyelet 36 acting as the first deflecting element and serves as a second, stationary deflecting element 13. A third guidance eyelet 38 is configured at a pivot arm 14 which is supported in such a manner that its pivot shaft coincides with the filling's deflection site constituted by the eyelet 36. Simultaneously the pivot shaft of the lever 14 is the rotor shaft of an electric drive motor 16 which is also mounted on the angular retention device 34. The motion of the pivot arm 14 is limited by stops 39 and 40.

In the above embodiments, the deflecting elements 11, 12, 13 always are eyelets. However, instead of eyelets the deflecting elements also may be in the form of rods or rollers. The deflecting element 11, of which the deflection site should coincide with the pivot shaft 15, may be mounted on this shaft. This feature however involves increasing the moment of inertia of the electric motor drive 16.

If more yarn braking is desired, additional deflecting elements in the form of eyelets or rods may be mounted on the brake arm 14 in a manner to guide the filling 10 in zig-zag manner. Otherwise the invention remains the same except that in this case the yarn tensile force as seen in the direction of yarn advance shall exert a torque on the pivot shaft 14 beyond the displaceable deflecting element 12.

The apparatus 23 of the invention may be used to generate, limit, control or regulate or adjust a desired yarn tensile force in particular as regards weft weaving-machines. The adjustments optionally may be manual. Preferably the yarn tensile force shall be monitored continuously. In particular applications, for instance when inserting fillings into weaving machines, monitoring at given times or at particular positions may suffice. The ascertained yarn tensile force or yarn tensile force also may be used to initiate partial operations of a weaving machine or the like, or to start or end them. Said tensile force or tension also may be displayed.

The application of the apparatus 23 of the invention is not restricted to airjet weaving machines. It may also be used as a yarn brake in other weaving machines, for instance in gripper tape weaving machines or gripper shuttle weaving machines or the like. It also may be used with other machinery, in particular other textile machines, for instance spinning machines, winding machines, knitting machines, hosiery machines, embroidering machines, sewing machines, beam machines, that is, with machines that process yarns or similarly guided objects.

The invention claimed is:

1. Apparatus for at least one of monitoring and adjusting a tensile force in a yarn, comprising:

spaced apart first and second yarn deflecting elements;

a third yarn deflecting element located between the first and second yarn deflecting elements, said third yarn deflecting element having a coefficient of friction that results in a reaction force exerted on a yarn engaging and deflected by the third yarn deflecting element when the yarn is moved across the third yarn deflecting element;

a swivel arm supporting the third yarn deflecting element, said swivel arm mounted for pivotal movement on a pivot shaft and wherein the third yarn deflecting element is located distally along said swivel arm relative to said pivot shaft, and is at least movable in positions out of alignment with the first and second yarn deflecting elements upon pivotal movement of the swivel arm on the pivot shaft;

one of said first and second yarn deflecting elements located substantially at the location of said pivot shaft and such that the third yarn deflecting element supported by the swivel arm may engage and deflect a yarn extending from the respective first or second yarn deflecting element located substantially at the pivot shaft location when the swivel arm is pivoted so that the third yarn deflecting element is non-aligned with the first and second yarn deflecting elements, whereby the yarn is substantially aligned with and intersects the pivot shaft;

an electric motor drive unit connected to the pivot shaft and arranged to respond to either or both torque applied by the swivel arm to the pivot shaft or movement of the swivel arm and the pivot shaft in response to a force exerted on the third yarn deflecting element by a tensioned yarn extending between the three deflecting elements when the third yarn deflecting element is supported by the swivel arm in a non-aligned position between the first and second yarn deflecting elements;

wherein, due to the location of the pivot shaft relative to the respective first or second yarn deflecting element located substantially at the pivot shaft location, and the third yarn deflecting element, the response of the electric motor drive is not influenced by the friction between the tensioned yarn and the third yarn deflecting element upon motion of the yarn between the first, second and third yarn deflection elements, but only by the tension force in a tensioned yarn portion extending in a single direction upstream or downstream of the third yarn deflecting element with regard to yarn motion when the third yarn deflecting element is non-aligned with the first and second yarn deflecting elements.

2. Apparatus as claimed in claim 1, wherein the pivot shaft and the respective first or second yarn deflecting element aligned with the pivot shaft is located upstream relative to the yarn direction of motion and the third yarn deflection element.

3. Apparatus as claimed in claim 1, wherein the distance between the third yarn deflecting element and the first or second yarn deflecting element that is not at the location of the pivot shaft is longer than the distance between the third yarn deflecting element and the second or first yarn deflecting element that is at the location of the pivot shaft.

4. Apparatus as claimed in claim 1, wherein said electric motor drive unit is adapted to respond to effects on the swivel arm selected from one or more of the group of effects consisting of instantaneous motion of the swivel arm, instantaneous position of the swivel arm, instantaneous torque applied to the swivel arm and instantaneous retention force exerted on the swivel arm by the electric motor drive.

5. Apparatus as claimed in claim 1, wherein at least two of said first, second and third yarn deflecting elements are configured as yarn guidance eyelets.

6. A weaving machine comprising a filling insertion system comprising the apparatus as recited in claim 1.

7. The weaving machine as claimed in claim 6, including a filling yarn brake, wherein said apparatus comprises said yarn brake.

8. The weaving machine as claimed in claim 6, including a main blow nozzle, wherein said apparatus as is arranged so the swivel arm is movable under the control of the electric motor drive to retract a filling yarn from the main blow nozzle.

9. The weaving machine as claimed in claim 6, including a yarn balloon limiter in a yarn supply device, and wherein the apparatus as is arranged as an assembly with said balloon limiter.

10. The weaving machine as claimed in claim 6, including a main blow nozzle having a yarn inlet, wherein the apparatus is located upstream of said yarn inlet relative to the direction of motion of a yarn supplied to the main blow nozzle, and said first or second yarn deflecting element not located at the location of the pivot shaft is said yarn inlet.

* * * * *